US005357046A

United States Patent [19]

Matsui et al.

[11] Patent Number: 5,357,046

[45] Date of Patent: Oct. 18, 1994

[54] AUTOMATIC PERFORMANCE APPARATUS AND METHOD

[75] Inventors: Haruhiko Matsui; Tessai Kondo, both of Hamamatsu, Japan

[73] Assignee: Kawai Musical Inst. Mfg. Co., Ltd., Shizuoka, Japan

[21] Appl. No.: 8,499

[22] Filed: Jan. 25, 1993

[30] Foreign Application Priority Data

Jan. 24, 1992 [JP] Japan ..... 4-011432
Jan. 24, 1992 [JP] Japan ..... 4-011433

[51] Int. Cl.[5] ..... G10H 1/18
[52] U.S. Cl. ..... 84/609; 84/634
[58] Field of Search ..... 84/123, 609, 610, 634

[56] References Cited

U.S. PATENT DOCUMENTS 5,254,803 10/1993 Terao ..... 84/609
5,281,755 1/1994 Matsui et al. ..... 84/609

*Primary Examiner*—Richard A. Wintercorn
*Assistant Examiner*—Patrick J. Stanzione

[57] ABSTRACT

According to the invention, elapsed time data indicative of a lapse of time are converted to greater values for permitting automatic performance according to the converted time data. Thus, it is made necessary, during fast forward of an automatic performance, only to convert the elapsed time data or time information of automatic performance information. In addition, the elapsed time data are converted into data, the value of which is reduced progressively with the lapse of time at a rate greater than the rate of change in the elapsed time data, for permitting automatic performance according to this data. Thus, it is made necessary, during rewind of an automatic performance, only to convert the elapsed time data or the time information of automatic performance information.

13 Claims, 10 Drawing Sheets

PANEL SWITCH GROUP
1
21
22
23
24
25
DISPLAY
4
FLOPPY DISK DRIVER
9
FLOPPY DISK
8
INPUT / OUTPUT INTERFACE
2
BUS LINE
3
CPU
5
TIME COUNTER
10
RAM
6
ROM
7
FF CONVERTED TIME DATA TABLE
REW CONVERTED TIME DATA TABLE
NORMAL CONVERTED TIME DATA TABLE
12a
12b
12c
SOLENOID DRIVER
13
14
CLOCK GENERATOR
11
φ
FAST FORWARD
REWIND
AUTOMATIC PERFORMANCE INFORMATION API

FIG. 4

12a

| Address | 0000 | 0001 | 0002 | 0003 | 0004 | 0005 | 0006 | 0007 | 0008 | 0009 | 0010 |
|---|---|---|---|---|---|---|---|---|---|---|---|
| FF converted time data FCT | 09 | 19 | 29 | 39 | 49 | 59 | 69 | 79 | 89 | 99 | 100 |

FIG. 5

12b

| Address | 0000 | 0001 | 0002 | 0003 | 0004 | 0005 | 0006 | 0007 | 0008 | 0009 | 0010 |
|---|---|---|---|---|---|---|---|---|---|---|---|
| REW converted time data RCT | 90 | 80 | 70 | 60 | 50 | 40 | 30 | 20 | 10 | 00 | 100 |

FIG. 6

12c

| Address | 0 | 1 | 2 | 3 | 4 | 5 | 6 | 7 | 8 | 9 |
|---|---|---|---|---|---|---|---|---|---|---|
| 000 | 00 | 01 | 02 | 03 | 04 | 05 | 06 | 07 | 08 | 09 |
| 001 | 10 | 11 | 12 | 13 | 14 | 15 | 16 | 17 | 18 | 19 |
| 002 | 20 | 21 | 22 | 23 | 24 | 25 | 26 | 27 | 28 | 29 |
| 003 | 30 | 31 | 32 | 33 | 34 | 35 | 36 | 37 | 38 | 39 |
| 004 | 40 | 41 | 42 | 43 | 44 | 45 | 46 | 47 | 48 | 49 |
| 005 | 50 | 51 | 52 | 53 | 54 | 55 | 56 | 57 | 58 | 59 |
| 006 | 60 | 61 | 62 | 63 | 64 | 65 | 66 | 67 | 68 | 69 |
| 007 | 70 | 71 | 72 | 73 | 74 | 75 | 76 | 77 | 78 | 79 |
| 008 | 80 | 81 | 82 | 83 | 84 | 85 | 86 | 87 | 88 | 89 |
| 009 | 90 | 91 | 92 | 93 | 94 | 95 | 96 | 97 | 98 | 99 |
| 010 | 100 | | | | | | | | | |

PRIOR ART

AUTOMATIC PERFORMANCE APPARATUS AND METHOD

BACKGROUND OF THE INVENTION

Field of the Invention

This invention relates to an automatic performance apparatus and method and, more particularly, to control of the fast forward and rewind of automatic performance.

Description of the Related Art

A conventional automatic performance apparatus is comprised basically as follows. A plurality of sets of musical information and time information are stored in a sequence memory and read out. A time counter is provided for counting elapsed time, and a clock signal at a predetermined frequency is supplied to the time counter. The count of the time counter and the read-out time information are compared. If the counted value becomes greater than the time information, a routine based on the music information for instance a sounding start or end routine, is executed. The above sequence of operations is repeatedly executed by reading out subsequent sets of music information and time information.

Of the conventional systems, there are two kinds of apparatuses which control the fast forward and rewind of automatic performance. FIG. 11 shows one kind of apparatus. The apparatus has a low frequency clock generator 91, which generates a clock signal at a usual low frequency, and a high frequency clock generator 92, which generates a clock signal at a high frequency. These clock signals at the low and high frequencies are supplied by a switching circuit 93 and a bus line to the time counter 94 noted above. The switching circuit 93 selects the high frequency clock signal when fast forward/rewind is designated, and it selects the low frequency clock signal in the absence of the fast forward-/rewind designation. When there is a fast forward-/rewind designation, the time counter 94 is incremented at a higher rate. Consequently, the automatic performance proceeds at a higher speed. In the rewind case, the music information and time information are read out reversely.

FIG. 12 shows the other kind of apparatus. The apparatus has a frequency divider 96, to which a clock signal generated from a clock generator 95 is input for conversion to a usual low frequency clock signal and a high frequency clock signal. These clock signals at the high and low frequencies are supplied through a switching circuit 97 and a bus line to the time counter 94. The switching circuit 97 selects the high frequency signal when fast forward/rewind is designated. Otherwise, it selects the low frequency clock signal in the absence of the fast forward/rewind designation. When fast forward/rewind is designated, the time counter 94 is incremented at a higher rate as in the above case, thus causing the automatic performance to proceed fast at an increased speed. In the rewind case, the music information and time information are read out in reverse.

In the above two kinds of apparatuses, however, it is necessary to provide the high frequency clock signal in addition to the usual low frequency clock signal. This means that either a plurality of clock generators 91 and 92 or a frequency divider 96 have to be provided, thus complicating the circuit construction and leading to cost increase.

An object of the invention is to dispense with a circuit for generating a high frequency clock signal, thus simplifying the circuit construction while readily permitting control of fast forward/rewind of automatic performance.

SUMMARY OF THE INVENTION

According to the invention, during fast forward, elapsed time data indicating elapsed time is converted to converted time data having a greater value for carrying out automatic performance. During, the elapsed time data is converted to converted time data, the value of which is reduced with the lapse of time at a rate greater than the rate of change in the elapsed time data, for carrying out automatic performance.

The above conversion may involve operations of storing and reading the converted time data in correspondence to elapsed time data, performing a calculation to obtain an increased rate of change in the elapsed time data, converting elapsed time data for a usual performance to a smaller value, and converting time information in automatic performance information to a smaller value. During in rewind, the calculation obtains a value which is reduced with the lapse of time. In summary, according to the invention, the rate of change in the elapsed time data is increased with respect to the time information in the automatic performance information. During in rewind, the elapsed time data is dealt with in reverse.

Thus, it is necessary only to convert either the elapsed time data or the time information in the automatic performance information. This means that a circuit for generating a high frequency clock signal is unnecessary, thus simplifying the circuit construction.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention and wherein:

FIG. 4 is a view showing a fast forward converted time data table 12*a* in a ROM 7;

FIG. 5 is a view showing a rewind converted time data table 12*b* in the ROM 7;

FIG. 6 is a view showing normal converted time data table 12*c* in the ROM 7;

DETAILED DESCRIPTION OF THE PREFERRED EMBODIMENT

Summary of the Embodiment

Figure 1:
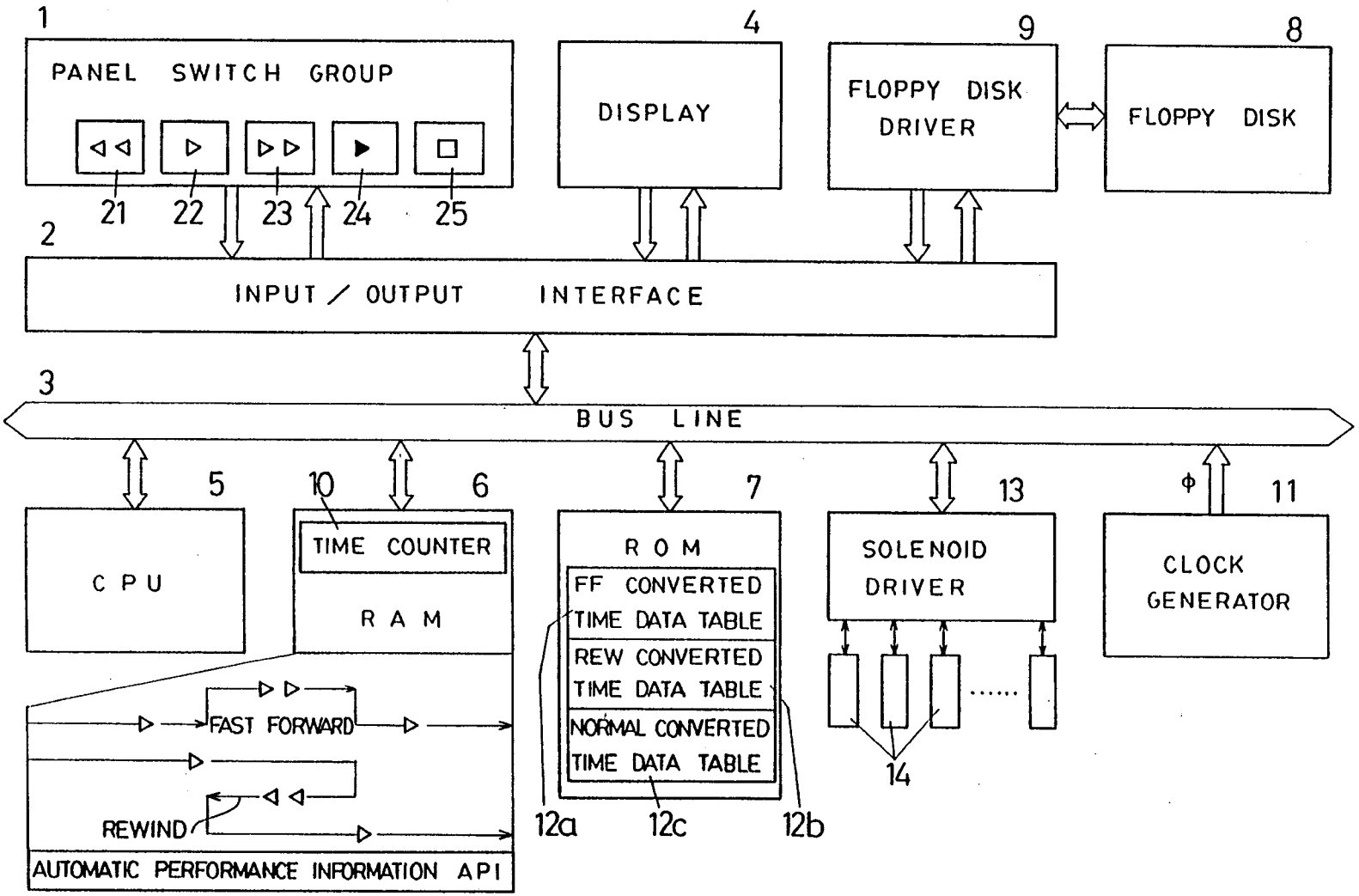
FIG. 1 is a block diagram showing the circuit of an automatic performance piano.

When forward key 23 is turned on (step 13 in FIG. 7), elapsed time data ET in time counter 10 is read out (step 14). The read-out elapsed time data ET is converted to FF (fast forward) converted time data FCT having a greater value with a FF converted time data table 12*a* (FIG. 4) (step 15) and set in a converted time data register 33 (step 16). The FF converted time data FCT and time information TI, which is set in step 42 (in FIG. 8) in sequence buffer register 32, are then compared (step 46). If the FF converted time data FCT is equal or greater than the time information TI, music information MI that is set in the sequence buffer register 32 is executed. Since the elapsed time data ET is expanded to FF converted time data FCT, the timing of execution of the music information MI becomes comparatively faster, and the automatic performance is executed in fast forward.

When rewind key 21 is turned on (step 17), elapsed time data ET in the time counter 10 is read out (step 18). The read-out elapsed time data ET is converted to REW converted time data RCT, the value of which is reduced with the lapse of time at a rate greater than the rate of change in the elapsed time data, with REW converted time data 12*b* (FIG. 5) (step 19) and set in converted time register 33 (step 16). The FF converted time data FCT and the time information TI, which has been set in step 32 in the sequence buffer register 32, are compared (step 36). If the REW converted time data RCT is no greater than the time information TI, music information MI that is set in the sequence buffer register 32 is executed. Since the elapsed time data ET is expanded to REW converted time data RCT and provided in reverse, the timing of execution of the music information MI becomes comparatively faster, the music information MI is executed in reverse, that is, the automatic performance is executed in rewind.

1. Overall Circuit

FIG. 1 shows the overall circuit of an automatic performance apparatus for an automatic performance piano. In a panel switch group 1, automatic performance control designation and so forth, to be described later, are effected. Key data indicating the operation of each key in the panel switch group 1 is temporarily stored in an input/output interface 2 and supplied via a bus line 3 to a CPU 5, and thus a routine corresponding to an operated key is executed. The key data has bits corresponding in number to the number of keys in the panel switch group 1, and "1" is set in a bit corresponding to an operated key. The panel switch group 1 may be such that a signal is output from a power source through an "on" key, or that key scan is effected with a sampling signal. Data, information, address data, etc., are supplied through the bus line 3.

Display data supplied from the CPU 5 or the like through the bus line 3 and input/output interface 2 is input to and displayed on a display 4. The displayed data indicates the operation of the panel switch group 1, routine execution by the CPU 5, performance time, etc. Automatic performance information API is stored on the floppy disk 8. The automatic performance information API is loaded for each music piece or for all music pieces in the RAM 6 through a floppy disk driver 9, input/output interface, and bus line 3, for automatic performance. Conversely, automatic performance information API may be saved on the floppy disk 8. The floppy disk 8 may be replaced with a RAM/ROM card, a magnetic tape, a magnetic disk, an optical disk, etc.

In the RAM 6 are stored various data obtained as a result of processing by the CPU 5 in addition to automatic performance information API. A time counter 10 is formed in the RAM 6. The time counter 10 is incremented according to a clock signal $\phi$ generated from a clock generator 11 to effect counting of elapsed time data ET. More specifically, the clock signal $\phi$ is supplied to the CPU 5, and whenever it is inverted to a high level, an interrupt routine to be described later is executed. In this routine, the time counter 10 is incremented by "+1".

It is possible that the time counter 10 is coupled to the clock generator 11 and incremented directly according to the clock signal $\phi$. The clock signal $\phi$ from the clock generator 11 has a fixed frequency. However, it is possible for the clock signal frequency to correspond to tempo data set by the panel switch group 1. In this case, the speed of the usual automatic performance and the speed of the fast forward/rewind automatic performance are varied according to the tempo that is set.

In the ROM 7 are set programs corresponding to flow charts to be described later and executed by the CPU 5 and programs corresponding to other routines. In the ROM 7 are also formed a FF converted time data table 12*a*, a REW converted time data table 12*b* and normal converted time data table 12*c*. In the FF converted time data table 12*a* are stored a large number of records of FF converted time data FCT which have been obtained through conversion of elapsed time data ET in the time counter 10 to greater values.

In the REW converted time data table 12*b* are stored a large number of REW converted time data RCT which have been obtained through conversion of elapsed time data ET in the time counter 10 to values decreasing with the lapse of time at a rate greater than the rate of change in the elapsed time data ET. The usual automatic performance is executed according to normal converted time data NCT obtained through conversion of elapsed time data ET in the time counter 10 with the normal converted time data table 12*c*. The fast forward/rewind of automatic performance is executed according to FF converted time data FCT obtained through conversion of the elapsed time data ET with the FF converted time data table 12*a* or REW converted time data RCT obtained through conversion with the REW converted time data table 12*b*.

Solenoids 14 are each provided under each of the keys and pedals of the automatic performance piano. When each solenoid 14 is energized, the associated key or pedal of the piano is turned on. When the solenoid 14 is de-energized, the key or pedal is turned off. The automatic performance information API in the RAM 6 is read out and supplied to the solenoid driver 13 by the CPU 5 for energizing and de-energizing the solenoids 14. In this way, automatic performance is executed.

The panel switch group 1 has a rewind key 21, a play key 22, a forward key 23, a record key 24 and a stop key 25. The rewind key 21 is used to initiate the rewind of automatic performance. The play key 22 is used to initiate the usual automatic performance. The forward key 23 is used to initiate the fast forward of automatic performance. The record key 24 is used to initiate designating the recording of automatic performance information API. The stop key 25 is used to stop the automatic performance.

The panel switch group 1 further has a load key, a save key, a power key, etc. (not shown). The load key is used to load automatic performance information API on the floppy disk 8 into the RAM 6, and the save key is used to save automatic performance information API in the RAM 6 onto the floppy disk 8. The panel switch group 1 further has a key group for setting tempo and a key group for music selection.

2. Automatic Performance Information API

Figure 2:
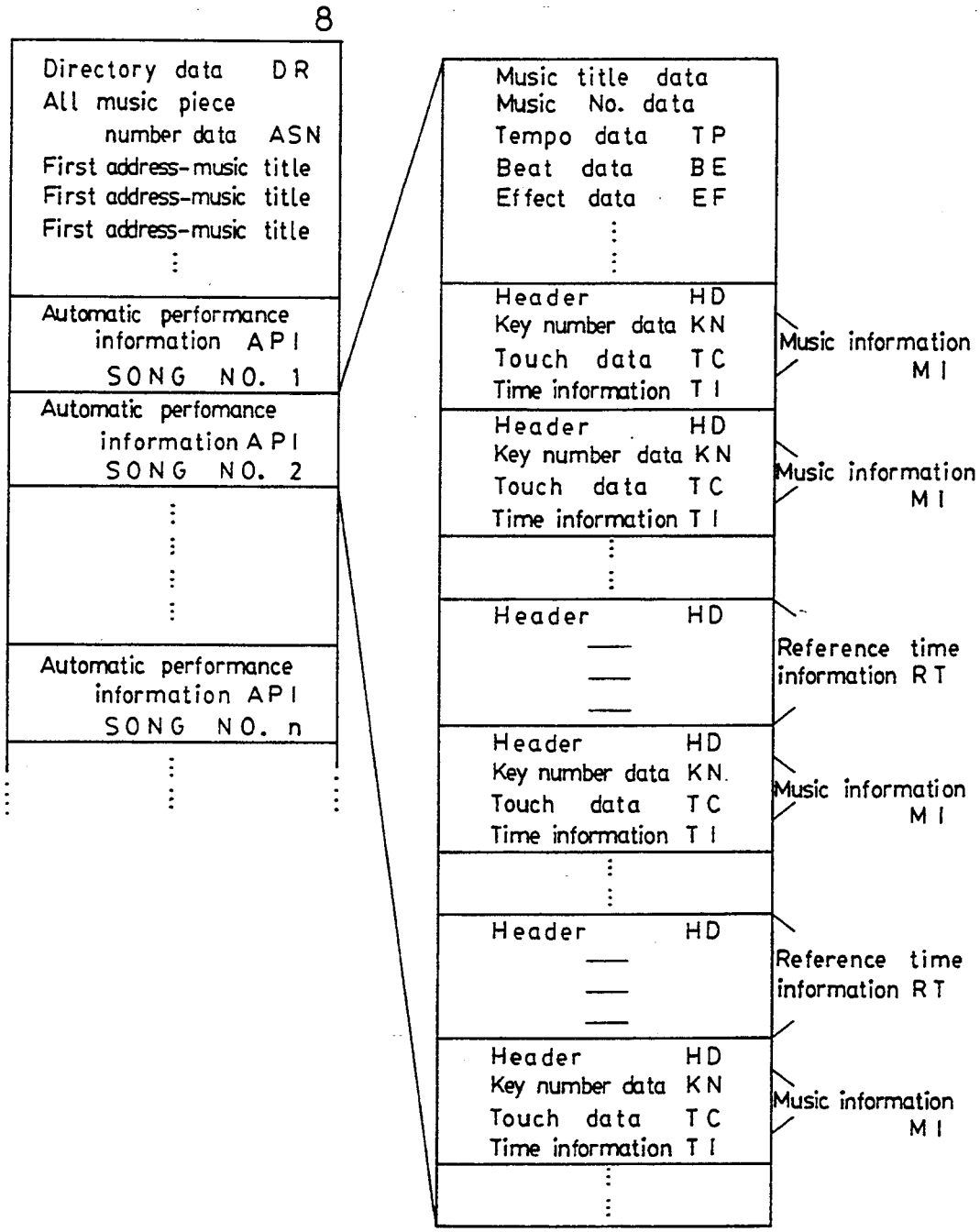
FIG. 2 is a view showing automatic performance information API stored on a floppy disk 8 or in a RAM 6.

FIG. 2 shows the automatic performance information API stored on the floppy disk 8 or the RAM 6. The automatic performance information API comprises a plurality of sets of header HD, music information MI and time information TL. The music information MI comprises key number data KN and touch data TC. The header HD is identification data for the music information MI and time information TI in one set.

The key number data KN indicates each key on the keyboard of the automatic performance piano and represents a tone pitch. This key number data KN includes data indicating key-"on" ("1") and key-"off" ("0"). It is possible to store data indicative of the on/off state of each pedal in lieu of the key number data KN. Touch (or velocity) data TC indicates the strength or speed of the on/off operation of the keys. The time information TI indicates the timing of execution of music information MI. The music information MI and time information TI are stored in the order of performance progress on the floppy disk 8. It is possible for the key number data KN to indicate the number of wind, string and percussion instrument sounds.

Figure 9:
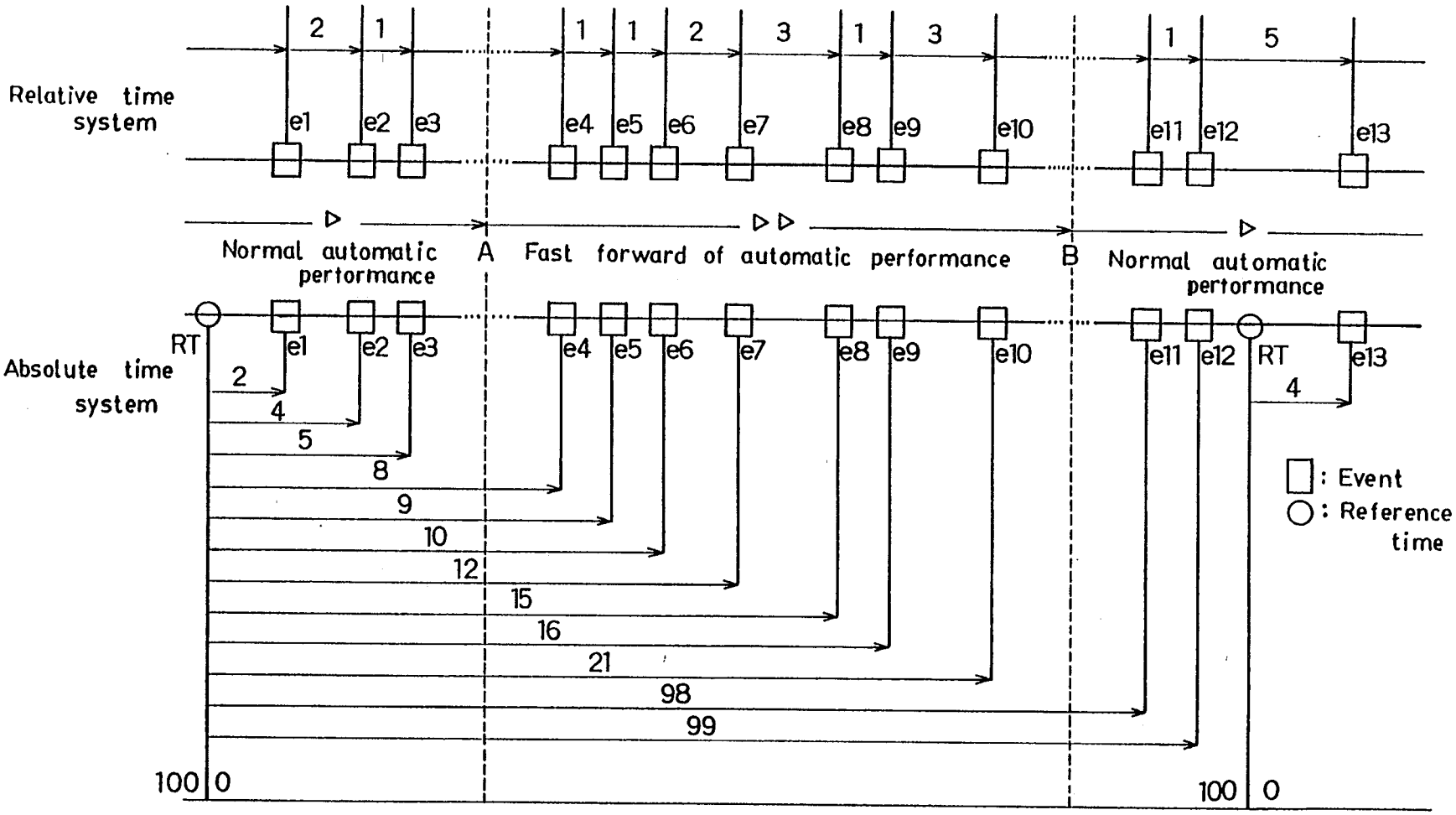
FIG. 9 is a view showing an example of the fast forward of automatic performance.
Figure 10:
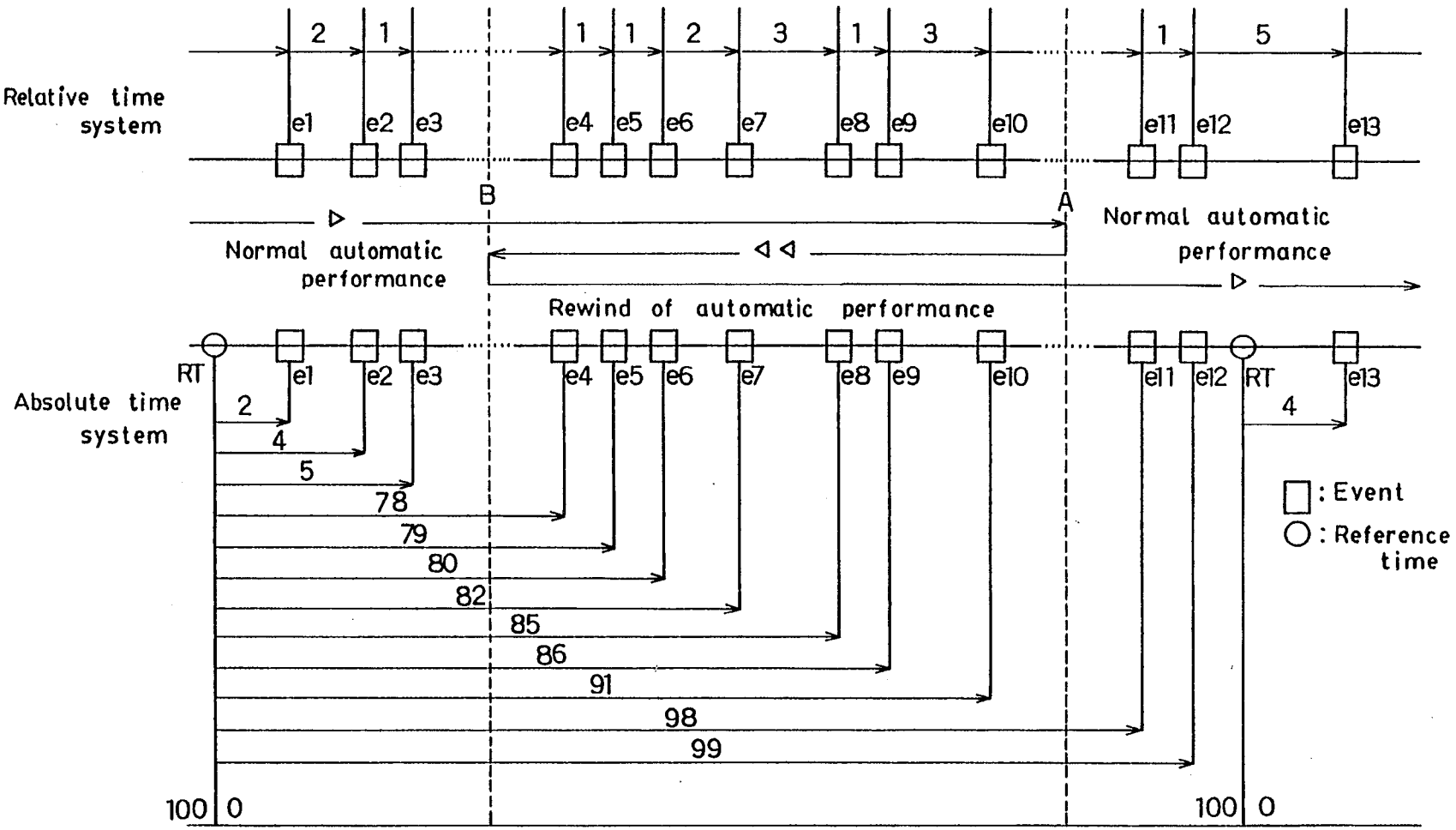
FIG. 10 is a view showing an example of the rewind of automatic performance.
Figure 11:
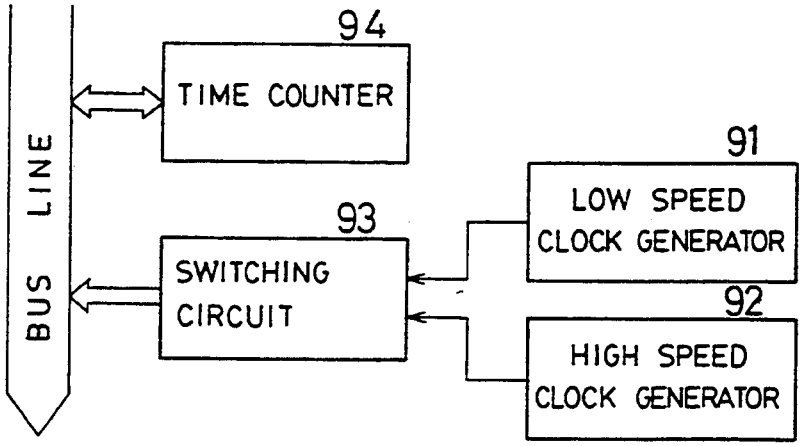
FIG. 11 is a circuit diagram showing a conventional system.
Figure 12:
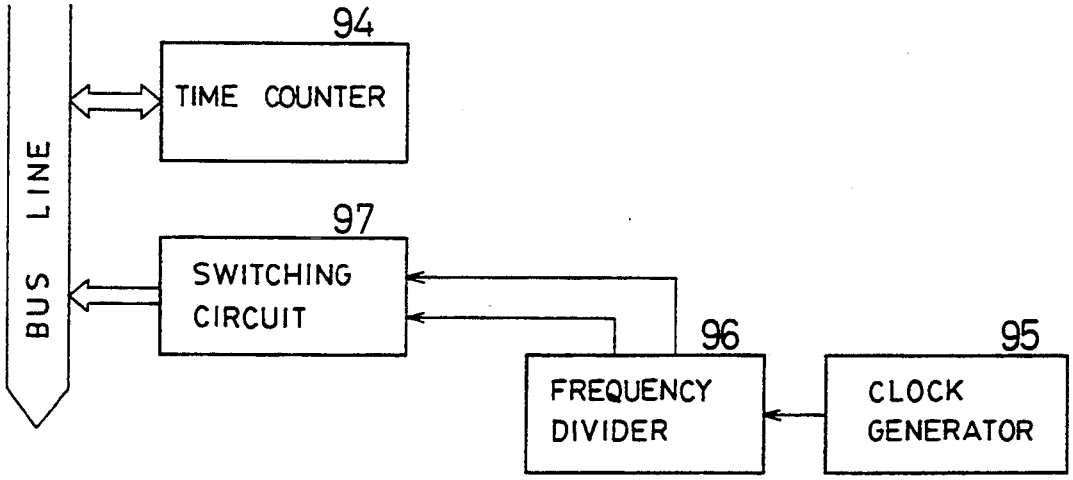
PRIOR ART FIG. 12
FIG. 12 is a circuit diagram showing another conventional system

The automatic performance information API includes some records of reference time information RT. The reference time information RT, as shown in FIGS. 9 and 10, indicates the reference "0" point of the time information TI such that the time information TI indicates time elapsed from that point. That is, the time information TI does not indicate relative time but indicates absolute time. The reference time information RT may be replaced with bar mark data. The bar mark data indicates the division of bars.

The reference time information RT is read out and executed at predetermined time intervals, for instance upon reaching a count of "100" in the time counter 10, corresponding to a time interval of 500 msec. At this time, the time counter 10 is cleared to "0", and performance time data is incremented by "+0.5". The reference time information RT comprises a header HD and three pieces of dummy data. The header HD identifies the reference time information RT. The data format of the header HD in the reference time information RT is different from that of the header HD in the music information MI. The automatic performance information API may include music name data, music number data, tempo data, beat data, effect data, etc.

3. RAM 6

Figure 3:
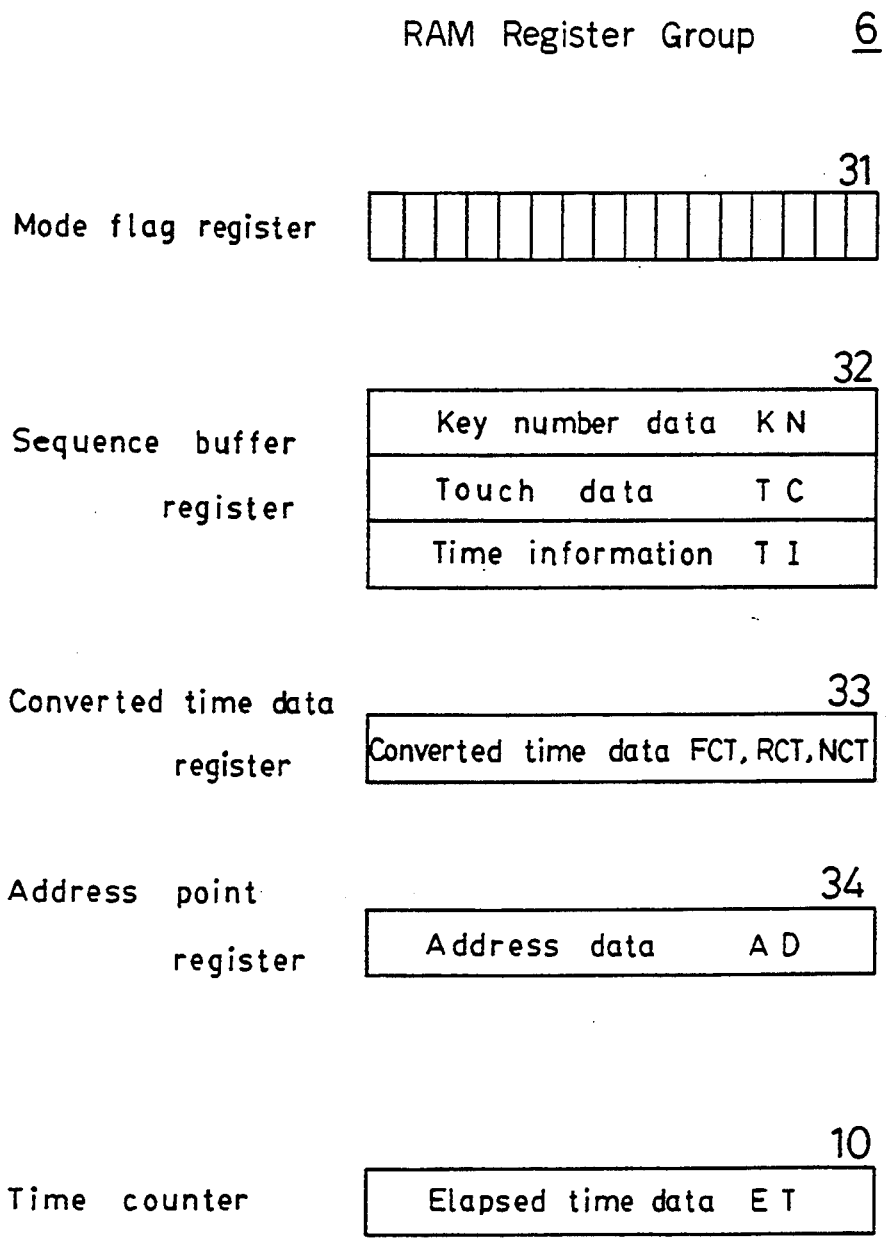
FIG. 3 is a view showing various registers in the RAM 6.

FIG. 3 shows various registers in the RAM 6. As shown, in the RAM 6 are formed a mode flag register 31, a sequence buffer register 32, a converted time data register 33, an address point register 34, and the time counter 10 noted above. In the mode flag register 31 are stored flag data indicating the "on" state of the rewind, play, forward, record and stop keys 21 to 25. For this flag data, "1" is set in each of the bits corresponding to the keys 21 to 25.

In the sequence buffer register 32, one set of music information MI and time information TI successively read out from the automatic performance information API is temporarily stored. In the converted time data register 33 is stored FF converted time data FCT, REW converted time data RCT or normal converted time data NCT to be described later. In the address point register 34 is set address data AD indicative of an automatic performance information API access address in the RAM 6.

4. FF Converted Time Data Table 12*a*

FIG. 4 shows the FF converted time data table 12*a* in the ROM 7. In the FF converted time data table 12*a*, FF converted time data FCT of "09", "19", "29", "39", . . . , "100" are set in respective addresses "0000", "0001", "0002", . . . , "0010". These address data "0000", "0001", "0002", . . . , "0010" correspond to the elapsed time data ET noted above. With this FF converted time data table 12*a*, elapsed time data ET are converted to FF converted time data FCT which is 104 greater values, i.e., ten times the values plus nine, such as "09", "19", "29", "39", . . . , "100".

For the fast forward of automatic performance, the time information TI of the automatic performance information API is compared to FF converted time data FCT for automatic performance. For the normal automatic performance, the time information TI is compared to normal converted time data NCT to be described later for automatic performance. The FF converted time data FCT of the FF converted time data table 12*a* are not limited to those above. For example, they may be "08", "16", "24", "32", . . . , or "10", "18", "26", "34", "42", . . . etc. Further, the FF converted time data may be of values other than those in the range of "00" to "100" in the case where the reference time information RT is stored at an interval other than "100". Further, it is possible to store 12 or more or 10 or fewer pieces of FF converted time data FCT in the FF converted time data table 12*a*.

5. REW converted time data table 12*b*

FIG. 5 shows the REW converted time data table 12*b* in the ROM 7. REW converted time data RCT "90", "80", "70", "60", . . . , "00", "100" are stored at locations "0000", "0001", "0002", "0003", . . . , "0009", "0010" in the REW converted time data table 12*b*. These address data of "0000", "0001", "0002", . . . , "0009", "0010" correspond to the elapsed time data ET noted above. The elapsed time data ET is converted with the FF converted time data table 12*b* to REW converted time data RCT, the value of which is reduced gradually with the lapse of time at a rate greater than the rate of change in the elapsed time data ET, i.e., "90", "80", "70", . . . , "00", "100" which are values of $(9-ET)\times 10$.

In the case of the rewind of automatic performance, the time information TI of the automatic performance information API is compared to the REW converted time data RCT for automatic performance. For normal automatic performance, the time information TI is compared to normal converted time data NCT to be described later for automatic performance. The REW converted time data RCT of the REW converted time data table 12*b* are not limited to those above. For example, they may be, "96", "88", "80", "72", . . . "00", "100" or "86", "78", "70", "62", "54", . . . , "00", "100", etc., Further, the REW converted time data RCT may take other values than those in the range of "00" to "100" in case when the reference time information RT is stored at an interval other than "100". Further, it is possible to store 12 or more or 10 or fewer pieces of REW converted time data RCT in the REW converted time data table 12b.

6. Normal converted time data table 12c

FIG. 6 shows the normal converted time data table 12c in the ROM 7. Normal converted time data NCT of "00", "01", "02", "03", . . . , "100" are stored at locations "0000", "0001", "0002", "0003", . . . , "0100" in the normal converted time data table 12c. The address data of "0000", "0001", . . . , "0100" correspond to the elapsed time data ET noted above, and the elapsed time data ET is converted with the normal converted time data table 12c into normal converted time data NCT.

In the example of FIG. 6, the normal converted time data NCT is equal to the elapsed time data ET, that is, the elapsed time data ET can be directly used as the normal converted time data NCT without use of the normal converted time data table 12c. However, when changing the normal converted time data NCT shown in FIG. 6 from the values of the elapsed time data ET, the normal converted time data table 12c is necessary. An example of such a case is when converting normal converted time data NCT to "00", "00", "01", "01", "02", "02". . . "05", "05", or to "02", "04", "06", "08", "10", "12". . . "20", "22". . . , with respect to elapsed time data ET of "01", "02", "03", "04", "05", "06", . . . "10", "11", . . .

Further, it is possible to use as the normal converted time data NCT those obtained through conversion of the elapsed time data ET to smaller values and use as the REW converted time data RCT or FF converted time data FCT, the direct elapsed time data ET or those obtained through conversion of the elapsed time data ET to values close thereto. In this case, it is possible to switch the normal automatic performance and the fast forward/rewind automatic performance by increasing the frequency of the clock signal $\phi$.

7. Interrupt routine

Figure 7:
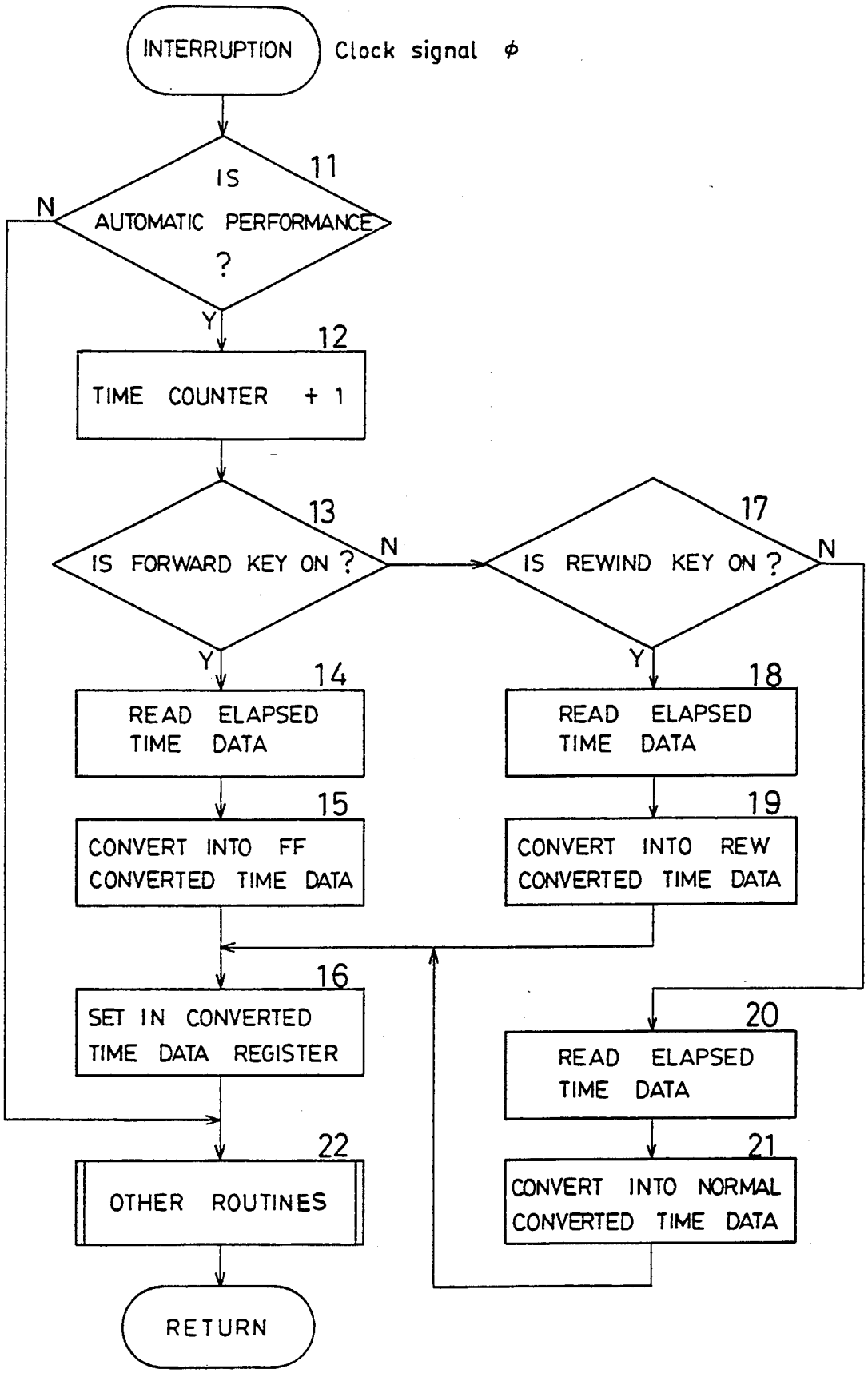
FIG. 7 is a view showing a flow chart of an interrupt routine.

FIG. 7 shows a flow chart of an interrupt routine executed by the CPU 5. In this routine, the elapsed time data ET in the time counter 10 is progressively incremented (step 12). If the fast forward of automatic performance is in force, the elapsed time data ET is converted into FF converted time data FCT (step 15). If the rewind of automatic performance is in force, the elapsed time data ET is converted into REW converted time data RCT (step 19). If normal automatic performance is in force, the elapsed time data ET is converted into normal converted time data NCT (step 21). This routine is executed whenever the clock signal $\phi$ supplied from the clock generator 11 to the CPU 5 is inverted to the high level.

In the details of this routine, a check is first made as to whether automatic performance is in progress or not (step 11). This check is made on the basis of whether the bit in the mode flag register 31 corresponding to the play key 22, forward key 23 or rewind key 21 is "1". Subsequently, the time counter 10 is incremented by "+1" (step 12), and whether the forward key 23 or rewind key 21 is turned on or not is checked (steps 13 and 17). These checks are based on whether the bit in the mode flag register 31 corresponding to the forward key 23 or rewind key 21 is "1".

If it is detected that the forward key 23 is "on", the elapsed time data ET in the time counter 10 is read out (step 14). The read-out elapsed time data ET is converted with the FF converted time data table 12a into FF converted time data FCT (step 15) and set in the converted time data register 33 (step 16). Thus, in every interrupt routine the elapsed time data ET in the time counter 10 is incremented by "+1", and it is expanded to 10 times plus 9.

If it is detected that the rewind key 21 is "on", the elapsed time data ET in the time counter 10 is read out (step 18). The read-out elapsed time data ET is converted with the REW converted time data table 12b into REW converted time data RCT (step 19) and set in the converted time register 33 (step 16). Thus, in every interrupt routine the elapsed time data ET in the time counter 10 is incremented by "+1" and converted to ten times (9−ET). In other words, the elapsed time data ET is converted such that its value is reduced progressively with the lapse of time at a rate greater than the rate of change in the above mentioned elapsed time data ET.

Further, if it is detected in the steps 13 and 17 that the play key 22 is "on", the elapsed time data ET in the time counter 10 is read out (step 20). The read-out elapsed time data ET is converted with the normal conversion time data table 12c into normal converted time data NCT (step 21), and set in the converted time data register 33 (step 16). Subsequently, other routines are executed (step 22), and then the routine returns. Thus, the elapsed time data ET in the time counter 10 is incremented by "+1" in every interrupt routine and processed without being expanded.

The checks of the flag data of the forward key 23 and rewind key 21 in the mode flag register 31 in the steps 13 and 17 fulfill the roles of selecting either the FF or REW converted time data table 12a or 12b or selecting the normal converted time data table 12c, that is, switching between the FF or REW converted time data FCT or RCT and normal converted time data NCT.

It is possible in the step 21 for the elapsed time data ET to be set in the converted time data register 23 without being converted with the normal converted time data 12c into the normal converted time data NCT. Further, it is possible that in the steps 15 and 19 for the elapsed time data ET to be multiplied by a value above "1" (for instance "9") instead of being converted with the FF or REW converted time data table 12a and 12b. Further, it is possible to cause plus/minus conversion of the elapsed time data ET, multiplication thereof by a value above "1" (for instance "9") and then add a predetermined value (for instance "100"). Further, it is possible to increment the elapsed time data ET by "+9" or "−10", whenever the clock signal $\phi$ is inverted to the high level. When this is done, the FF or REW converted time data table 12a or 12b can be dispensed with.

Further, it is possible for the normal converted time data data NCT stored in the normal converted time data table 12c to be such that it makes the elapsed time data ET smaller, for instance "1/9" or "1/10". Further, it is possible in the step 19 for the elapsed time data ET to be multiplied by a value less than "1" (for instance "1/9" or "1/10"). Further, it is possible to add "1/9" or "1/10" to the elapsed time data ET whenever the clock signal $\phi$ is inverted to the high level. Further, it is possible to carry out the above arithmetic operations on the elapsed time data ET, in steps 31 and 41 to be described later, without having the time counter 10 cleared.

Further, it is possible to omit the step 12 of incrementing the elapsed time data ET and, if "YES" results in the step 17 of checking the on/off state of rewind key 21, to decrement inversely the elapsed time data ET before execution of the step 18 and the step 19 so as to convert the elapsed time data ET to a greater value in the step 19. For example, the elapsed time data ET may be decremented to "10", "09", "08", "07", . . . and converted to "100", "90", "80", "70", . . . . In such a case, if the result of the step 17 for checking the on/off state of the rewind key 21 is judged to be "NO", or if the result of the step 13 for checking the on/off state of the forward key 23 is judged to be "YES", the elapsed time data ET is incremented, and the routine goes to the step 20.

Further, in the above conversion it is possible that when the rewind key 21 is on, the elapsed time data ET can be decremented to a value less than "1" and converted in the step 19 to a greater value. For example, the elapsed time data ET may be decremented to "10.0", "9.9", "9.8", "9.7". . . , and converted to "100", "99", "98", "97". . . .

In decrementing the elapsed time data ET, when the clock signal $\phi$ is directly supplied to the time counter 10, an 1/0 signal is supplied through a latch to the up/-down terminal U/D in the interruption routine. In this case, if the play key 22 or forward key 23 is "on" a signal "1" is supplied, while signal "0" is supplied if the rewind key 21 is "on", in the interruption routine.

8. Automatic performance routine

Figure 8:
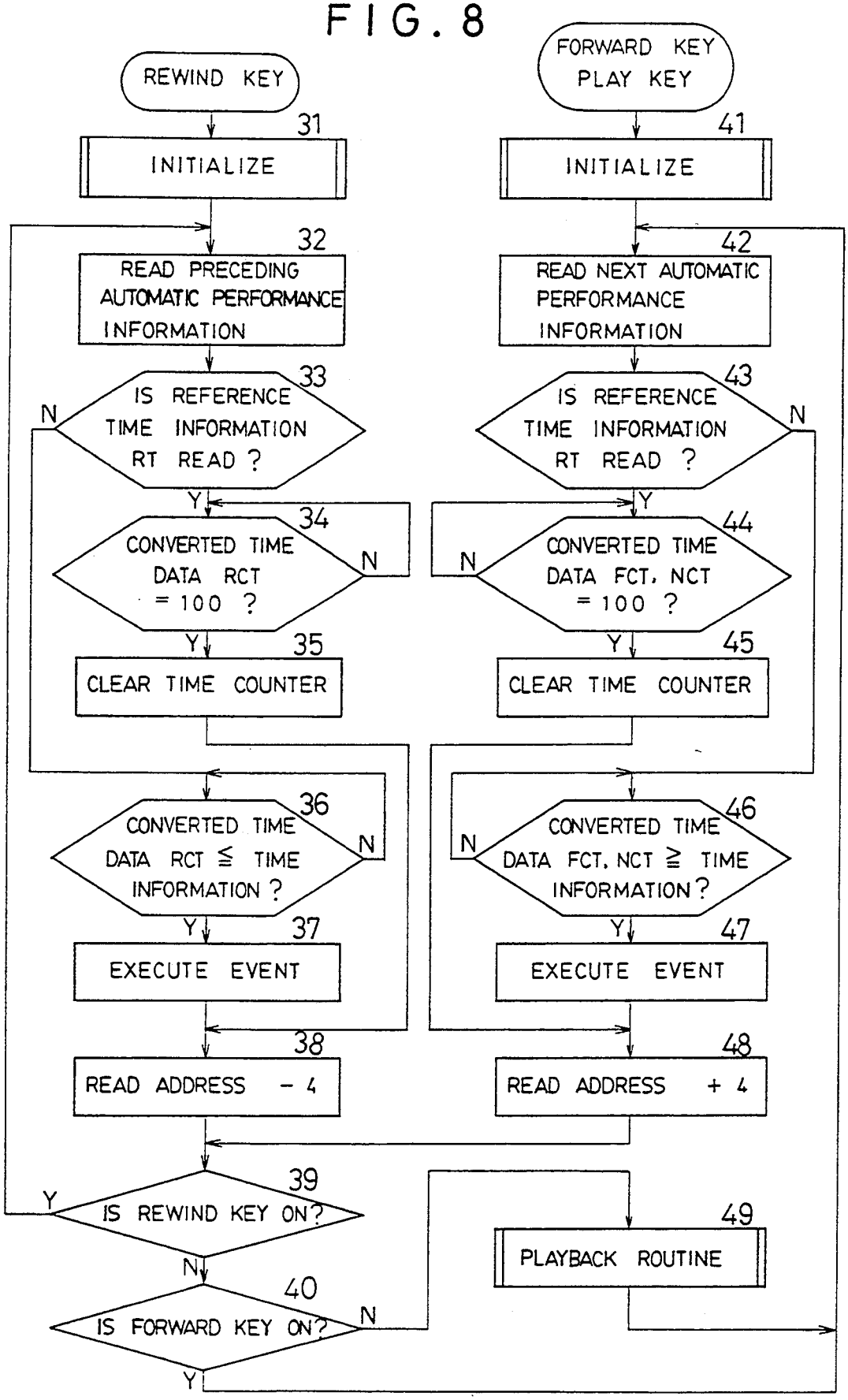
FIG. 8 is a view showing a flow chart of an automatic performance routine.

FIG. 8 is a flowchart of the automatic performance executed by the CPU 5. In this routine, in the rewind of automatic performance the automatic performance information API is read out in reverse (steps 38 and 32). If the reference time information RT is read out, the routine goes into stand by (steps 33 and 34). If the music information MI and time information TI are read out, an event corresponding to the music information MI is executed with a timing corresponding to the time information TI (steps 36, 37). In the fast forward automatic performance or the normal automatic performance, the automatic performance information API is read out progressively (steps 48, 42). If the reference time information RT is read out, the routine goes into stand by (steps 43 and 44). If the music information MI and time information TI are read out, an event is executed with a timing corresponding to the time information TI (steps 46 and 47). In this case, the REW converted time data RCT in the step 36 or the FF converted time data FCT in the step 46 has been expanded to be greater than the normal converted time data NCT, so the event is correspondingly executed more quickly.

In this process, the routine is started when the play key 22, forward key 23 or rewind key 21 is turned on in the key routine in the main routine. The main routine is started when the power key is turned on. After the initialization routine, the key routine is repeatedly executed. In the initialization routine, all data in the RAM 6, input/output interface 2 and solenoid driver 13 are cleared. At this time, if the first location of the destination for loading the automatic performance information API in the RAM 6 is not "00 . . . 0", the address data AD in the address point register 34 of the RAM 6 is made the same as the first address.

First, when the rewind key 21 is turned on, the initialization routine is executed (step 31). In the initialization routine, the time counter 10, mode flag register 31, etc, in the RAM 6 are cleared, the maximum value "11 . . . 1" is set in the converted time data register 33, and flag data of "1" is set in the bit of the mode flag register 31 corresponding to the rewind key 21. The time counter 10 is incremented by "+1" whenever the clock signal $\phi$ supplied from the clock generator 11 to the CPU 5 changes to the high level. The incrementing by "+1" is executed as part of the interrupt routine.

Next, data of the automatic performance information API in the RAM 6 designated by the address data AD in the address point register 34 is read out and set in the sequence buffer register 32 (step 32). Then, if the reference time information RT is read out (step 33), the routine is suspended until the REW converted time data RCT becomes "100", i.e., until reaching a timing or moment corresponding to the reference time information RT (step 34). The REW converted time data RCT is stored in the converted time register 33 in the above step 16. When the REW converted time data RCT reaches "100", the time counter 10 is cleared (step 35), the performance time data is incremented by "+0.5", and the address point register 34 is decremented by "−4" (step 38).

When the music information MI and time information TI are read out in the step 32, the time information TI is compared to the REW converted time data RCT (step 36). As long as the REW converted time data RCT is greater, the routine is suspended. When the REW converted time data RCT becomes less than the time information TI after a lapse of time, an event corresponding to the music information MI in the sequence buffer register 32 is executed (step 37). Then, the address point register 34 is decremented by "−4" (step 38).

In this case, in the above step 15, the elapsed time data ET in the time counter 10 is converted to ten times (9−ET), i.e., into data, the value of which is reduced gradually with the lapse of time at a rate greater than the rate of change in the elapsed time data ET. Thus, in the step 36, the time until the FF converted time data FCT becomes less than the time information TI of the automatic performance information API is shortened, so that the execution goes to the preceding event more quickly. In this way, the automatic performance rewind can be realized without increasing the frequency of the clock signal $\phi$.

Also, the initialization routine is executed even when the forward key 23 or play key 22 is turned on (step 41). In this initialization routine, the time counter 10, converted time data register 33, mode flag register 31, etc, are cleared, and flag data of "1" is set in the bit of the mode flag register 31 corresponding to the forward key 23 or play key 22. The time counter 10 is incremented by "+1" whenever the clock signal $\phi$ supplied from the clock generator 11 to the CPU 5 changes to the high level. The incrementing by "+1" is executed as part of operation in the interrupt routine.

Next, data of the automatic performance information API in the RAM 6 designated by the address data AD in the address point register 34 is read out and set in the sequence buffer register 32 (step 42). Then, if the reference time information RT is read out (step 43), the routine is suspended until the FF or normal converted time data FCT or NCT noted above becomes "100", i.e., until reaching the timing corresponding to the reference time information RT (step 44). The FF or normal converted time data FCT and NCT is stored in the converted time data register 33 in the step 16. When the normal converted time data NCT reaches "100", the time counter 10 is cleared (step 45), the performance time data is incremented by "+0.5", and the address point register 34 is incremented by "+4" (step 48).

When the music information MI and time information TI are read out in the step 42, the time information TI is compared to the FF or normal converted time data FCT or NCT (step 46). If the FF or normal converted time data FCT or NCT is less, the routine waits. When the FF or normal converted time data FCT or NCT becomes greater than the time information TI after a lapse of time, the event corresponding to the music information MI in the sequence buffer register 32 is executed (step 47). Then, the address pointer register is incremented by "+1" (step 48).

In this case, if the forward key 23 is "on", in the above step 15, the elapsed time data ET in the time counter 10 is expanded to ten times plus nine, so that the time until the FF converted time data FCT exceeds the time information TI of the automatic performance information API in the step 46 is reduced, thus permitting the next event to be executed more quickly. Thus, it is possible to realize the fast forward of automatic performance without increasing the frequency of the clock signal $\phi$.

In the event execution routine of steps 37 and 47, the keys and pedals are not driven, but preparation for the next event read-out, accumulation of performance time data, etc., are carried out. The keys or pedals are driven in step 49 in a playback routine. This playback routine is not executed at the time of the fast forward or rewind of automatic performance. That is, the fast forward and rewind automatic performance are executed in a muted state. This is because at the time of the fast forward and rewind, the driving of solenoid 14 does not follow the fast forward and rewind of automatic performance. Of course, it is possible for the routine in the step 49 to be executed prior to the step 39, thus allowing the keys and pedals to be driven at the time of the fast forward or rewind of automatic performance.

After the step 38, a check is made as to whether the rewind key 21 or forward key 23 has been turned on (steps 39 and 40). This check is based on whether the bit in the mode flag register 31 corresponding to the rewind key 21 or forward key 23 is "1". If the rewind key 21 or forward key 23 is "on", the routine goes back to the step 32 or 42 to repeat the automatic performance routine.

If it is found in the steps 39 and 40 that the play key 22 is "on", the playback routine is executed (step 49). In the playback routine, data corresponding to touch data TC is supplied to the input lines of solenoid drivers 13 corresponding to the key number data KN of the music information MI. Thus, a key or a pedal corresponding to the key number data KN is driven at a speed or with a strength corresponding to the touch data TC.

When the stop key 25 is turned on, program read-out corresponding to the automatic performance routine is stopped unconditionally, thus ending the automatic performance routine. The sequence buffer register 32 and address point register 34 are cleared when the power key is turned on, but they are not cleared when the play key 22, forward key 23, rewind key 21 or stop key 25 is turned on. Of course, it is possible to clear these registers when any of the keys 21, 22, 23 and 25 are turned on. In such a case, the routine corresponding to the operation of the key 21, 22, 23 or 25 is executed from the start or end of a music piece.

It is possible between the steps 33 and 36 for the time information TI read out in the step 32 to be converted to a smaller value before the routine goes to the step 36. Further, for the conversion of the time information TI a memory may be used which has the same construction as the REW converted time data table **12*b*, and in which data obtained by reducing the time information TI is stored. Further, the time information TI may be multiplied by a value less than "1" (for instance "1/10"). Then, when the rewind key 21** is turned on, the elapsed time data ET is decremented as described before in connection with the interrupt routine. Again in this case, the rewind of automatic performance can be realized.

Further, between the steps 43 and 46, a check of the on/off state of the forward key 23 same as in the step 40 may be executed, and if the forward key 23 is "on", the time information TI read out in the step 42 is converted to a smaller value data. If the play key 22 is "on", the routine goes to the step 46.

For the conversion of the time information TI a memory may be used which has the same construction as the FF converted time data table **12*a*, and in which data obtained by reducing the time information TI is stored. The time information TI may be multiplied by a value less than "1" (for instance "1/9"). Even in this case, the fast forward of automatic performance can likewise be realized. Further, it is possible, if the play key 22 is "on", for the time information TI to be converted with the normal converted time data 12*c* and for the routine to then go to the step The automatic performance routine in FIG. 8 is executed repeatedly until the stop key 25 is turned on. However, it is possible to have the routine in FIG. 8 executed only when the forward key 23, rewind key 21 or play key 22 is on, and to let the routine return if "NO" results in the steps 36 and 46. In this case, after the step 16 of the interrupt routine, the routine goes to the step 32 or 42 for execution of the steps 32 to 40 and 42 to 49, and if "NO" results in the step 36 or 46**, the routine returns.

Further it is also possible to have the automatic performance routine in FIG. 8 executed as follows. If the result of the check in the step 36 or 46 is "NO", the routine in the steps 13 to 21 in FIG. 7 is executed, and the routine returns to the step 36 or 46. In this case, the interrupt routine is unnecessary, although the routine for incrementing the time counter 10 in the step 12 is still needed.

9. Example of fast forward of automatic performance

FIG. 9 shows an example of the fast forward of automatic performance. In the Figure, "el", "e2", . . . represent music information MI, and RT represents reference time information RT. The music information MI and reference time information RT are stored in an absolute time system as shown in the lower portion of FIG. 9. It is assumed that the music information MI of "el", "e2" and "e3" is executed in the normal automatic performance and that the forward key 23 is turned on at time point A.

As a result, all data that was supplied to the solenoid driver 13 is cleared to turn off the keys and pedals, and the converted time data register 33 and time counter 10 are cleared (step 41). At this time, the music information MI of "e4" is set in the sequence buffer register 32, and the processing of music information MI is suspended until the execution timing.

The elapsed time data ET in the time counter 10 cleared to "00" is converted with the FF converted time data table **12*a* into FF converted time data FCT of "09" (step 15). As a result, since the time information TI of "e4" is "8" (step 46), the music information MI of "e4" is executed immediately (step 47). Then, the next music information MI of "e5" and time information TI are read out (step 42). Since the time information TI of "e5" is "9" (step 46), the music information MI of "e5" is again executed immediately (step 47). In this way, the music information MI of "e4" and "e5**" are executed continuously.

Subsequently, when the elapsed time data ET of the time counter 10 becomes "01", the elapsed time data ET is converted with the FF converted time data table 12*a* into FF converted time data FCT of "19" (step 15). As a result, music information MI of "e6" to "e9" is likewise executed continuously (steps 46, 47, 48 and 42). It is thus possible to effect the fast forward of automatic performance without increasing the frequency of the clock signal $\phi$.

Next, it is assumed that the play key 22 is turned on at time point B in FIG. 9. As a result, all data that was supplied to the solenoid driver 13 is cleared to turn off the keys and pedals, and the converted time data register 33 and time counter 10 are cleared (step 41). At this time, the music information MI of "e10" is set in the sequence buffer register 32, and the processing of music information MI is suspended until the execution timing.

Since the elapsed time data ET in the time counter 10 has been cleared to "00" and that the time information TI of "e10" of "21" has been set in the sequence buffer register 32, no music information MI is executed until the elapsed time data ET becomes "21". When the elapsed time data ET becomes "21" (step 46), the music information MI of "e10" is executed (step 47), and the next music information MI and time information TI of "e11" are read out (step 42). Subsequently, the normal automatic performance is continued.

10. Example of rewind of automatic performance

FIG. 10 shows an example of the rewind of automatic performance. In the Figure, "e1", "e2", . . . represent music information MI, and RT represents reference time information RT. The music information MI and reference time information RT are stored by an absolute time system as shown in the lower portion of FIG. 10. It is assumed that the music information MI of "e1", "e2", . . . "e7" in FIG. 10 is executed in the normal automatic performance and that the rewind key 21 is turned on at time point A.

As a result, all data that was supplied to the solenoid driver 13 is cleared to turn off the keys and pedals, and the converted time data register 33 and time counter 10 are cleared (step 31). At this time, the music information MI of "e7" is set in the sequence buffer register 32, and the execution of this music information MI is suspended until the execution timing.

The elapsed time data ET in the time counter 10 cleared to "00" is converted with the REW converted time data 12*b* into REW converted time data RCT of "90" (step 19). As a result, since the time information TI of "e7" is "82" (step 36), the routine is suspended. When the elapsed time data ET becomes "01", since the REW converted time data RCT becomes "80", this time, the music information MI of "e7" is executed (step 37), and the immediately preceding "e6" music information MI and time information TI are read out (step 32). Since the time information TI of "e6" is "80" (step 36), the music information MI of "e6" is again executed immediately (step 37). In this way, the music information MI of "e7" and "e6" is executed continuously.

When the elapsed time data ET in the time counter 10 becomes "02", the elapsed time data ET is converted with the REW converted time data table 12*b* into REW converted time data RCT of "70" (step 19). As a result, the music information MI of "e5" and "e4" is likewise executed continuously (steps 36, 37 and 32). In this way, it is possible to obtain the rewind of automatic performance without increasing the frequency of the clock signal $\phi$.

Next, it is assumed that the play key 22 is turned on at time point B in FIG. 10. As a result, all data that was supplied to the solenoid driver 13 is cleared to turn off the keys and pedals, and the converted time data register 33 and time counter 10 are cleared (step 41). At this time, the music information MI of "e3" is set in the sequence buffer register 32, and the execution of the music information MI is suspended until the execution timing.

Since the elapsed time data ET in the time counter 10 has been cleared to "00" and the time information TI of "e3" of "05" has been set in the sequence buffer register 32, no music information MI is executed until the elapsed time data ET becomes "05", and when the elapsed time data ET becomes "05" (step 46), the music information MI of "e3" is executed (step 47). Then, the next music information MI and time information TI of "e4" are read out (step 42), and subsequently the normal automatic performance is executed continuously.

In the examples of FIGS. 9 and 10, the fast forward and rewind of automatic performance are not executed beyond the reference time information RT but in a shorter period of time. However, it is possible to have the fast forward and rewind of automatic performance executed beyond the reference time information RT.

The automatic performance described above may also be obtained with the automatic performance information API stored by a relative time system as shown in upper portions of FIGS. 9 and 10. In this case, the time information TI in the relative time system is accumulated whenever the read-out is effected in the step 32 or 42, and the accumulated time information TI and the FF or normal converted time data FCT and NCT are compared in the step 36 or 46. In this case, the steps 33 to 35 and 43 to 45 in FIG. 8 are omitted.

The above embodiments of the invention are by no means limitative, and various changes and modifications are possible without departing from the scope and spirit of the invention. For example, the invention is applicable to electronic musical instruments. In this case, in the execution of the steps 37 and 47 concerning the music information MI, the music information MI is supplied to a tone generator or MIDI interface. Further, in addition to the automatic performance information API on the floppy disk 8, signals detected by key sensors from the key operation of the automatic performance piano or data input by computer may be recorded.

Further, the conversion of the elapsed time data ET in the steps 15 and 19 may be effected on the basis of particular operation formulas. An example of an operation formula is $FCT=a(ET)\pm b$, $a(ET)^2\pm b$, $b/\{a(ET)\}$ (where a and b are constants, ET is the elapsed time data, and FCT is the FF converted time data). Further, it is possible to store the automatic performance data API in a RAM/ROM card, a magnetic tape, a magnetic disk, an optical disk, etc., as well as on the floppy disk 8 and in the RAM 6.

What is claimed is:

1. An automatic performance apparatus comprising:

storage means for storing a plurality of sets of music information and time information;

information reading means for reading out said sets of music information and time information in a sequence of progress of performance from said storage means;

time counting means for counting elapsed time;

time data conversion means for converting, at the time of a fast forward or rewind of automatic performance, elapsed time data counted by said time counting means into data of a greater value or a value of which is reduced progressively over a lapse of time at a rate greater than the rate of change in said elapsed time data;

selection means for selecting the converted time data from said time data conversion means and the elapsed time data counted by said time counting means;

comparing means for comparing said converted or elapsed time data selected by said selection means with the time information read out by said information reading means; and music processing means for executing the fast forward or rewind of automatic performance through a routine based on music information read out by said information reading means according to the result of comparison by said comparing means.

2. The automatic performance apparatus according to claim 1, wherein said time data conversion means comprises:

converted time data storage means for storing a converted time data group obtained through conversion of elapsed time data counted by said time counting means into greater values: and converted data reading means for reading converted time data corresponding to the elapsed time data counted by said time counting means from said converted time data storage means.

3. The automatic performance apparatus according to claim 1, wherein said time data conversion means comprises:

converted time data storage means for storing a converted time data group obtained through conversion of elapsed time data counted by said time counting means into a value of which is reduced progressively over a lapse of time at a rate greater than the rate of change in said elapsed time data; and converted time data reading means for reading out converted time data corresponding to the elapsed time data counted by said time counting means from said converted time data storage means.

4. The automatic performance apparatus according to claim 1, wherein said time data conversion means performs an operation for expanding the rate of change in the elapsed time data counted by said time counting means.

5. The automatic performance apparatus according to claim 1, wherein said time data conversion means performs an operation of reducing the elapsed time data counted by said time counting means progressively over a lapse of time at a rate greater than the rate of change in said elapsed time data.

6. The automatic performance apparatus according to claim 1, wherein said converted time data the value of which is reduced progressively over a lapse of time by said time data conversion means, is obtained by reverse counting of time by said time counting means.

7. An automatic performance apparatus comprising:

storage means for storing a plurality of sets of music information and time information:

information reading means for reading said sets of music information and time information in a sequence of progress of performance:

time counting means for counting an elapsed time:

time data conversion means for converting, during normal automatic performance, elapsed time data counted by said time counting means to smaller values:

selection means for selecting converted time data obtained from said time data conversion means and the elapsed time data or data reversed from the elapsed time data counted by said time counting means:

comparing means for comparing the converted time data or the elapsed time data or the data reversed from the elapsed time data selected by said selection means to the time information read out by said information reading means; and music processing means for executing a fast forward or rewind of automatic performance through a routine based on music information read out by said information reading means.

8. The automatic performance apparatus according to claim 7, wherein said time data conversion means comprises:

converted time data storage means for storing a converted time data group obtained through conversion of the elapsed time data counted by said time counting means into smaller values; and converted data reading means for reading converted time data corresponding to the elapsed time data counted by said time counting means from said converted time data storage means.

9. The automatic performance apparatus according to claim 7, wherein in said time data conversion means, the rate of change in the elapsed time data counted by said time counting means is converted to smaller values.

10. The automatic performance apparatus according to claim 7, wherein said smaller values obtained progressively over the lapse of time from said time data conversion means are obtained by reverse counting of time by said time counting means.

11. The automatic performance apparatus according to claim 7, wherein said data reversed from said elapsed time data is obtained by the reverse counting of time by said time counting means.

12. An automatic performance apparatus comprising:

storage means for storing a plurality of sets of music information and time information:

information reading means for reading said sets of music information and time information in a sequence of progress of performance from said storage means:

time information conversion means for converting, at the time of a fast forward or rewind of automatic performance, time information, read out by said information reading means, into smaller values:

selection means for selecting the converted time information obtained from said time conversion means and the time information read out from said information reading means:

time counting means for counting an elapsed time:

comparing means for comparing the converted time information or the time information selected by said selection means and the elapsed time data or data reversed from the elapsed time data counted by said time counting means; and music processing means for effecting the fast forward or rewind of automatic performance in a routine based on music information read out by said information reading means according to the result of comparison by said comparing means.

13. The automatic performance apparatus according to claim 12, wherein said data reversed from said elapsed time data is obtained by the counting of time by said time counting means.

* * * * *